US005080558A

United States Patent [19]

Tran

[11] Patent Number: 5,080,558

[45] Date of Patent: Jan. 14, 1992

[54] CONTROL STAGE NOZZLE VANE FOR USE IN PARTIAL ARC OPERATION

[75] Inventor: Mank H. Tran, Orlando, Fla.

[73] Assignee: Westinghouse Electric Corp., Pittsburgh, Pa.

[21] Appl. No.: 534,565

[22] Filed: Jun. 7, 1990

[51] Int. Cl.[5] ..... F01D 9/04

[52] U.S. Cl. ..... 415/191; 415/208.1; 415/217.1; 29/889.7

[58] Field of Search ..... 415/121.2, 169.1, 169.2, 415/169.3, 191, 202, 208.1, 217.1; 29/889, 889.21, 889.7

[56] References Cited

U.S. PATENT DOCUMENTS 1,755,321 4/1930 Hendrickson ..... 415/217.1
3,699,623 10/1972 Kreider ..... 416/224
4,274,804 6/1981 Teshima et al. ..... 415/121.2
4,780,057 10/1988 Silvestri, Jr. ..... 415/202

FOREIGN PATENT DOCUMENTS 48703 3/1983 Japan ..... 415/168
63305 4/1984 Japan ..... 415/208
309235 1/1928 United Kingdom ..... 29/889.7

*Primary Examiner*—Edward K. Look
*Assistant Examiner*—James A. Larson
*Attorney, Agent, or Firm*—K. Bach

[57] ABSTRACT

For steam turbines capable of being operated in partial arc operation, the primary arc of admission is provided with nozzle vanes having a thicker trailing edge as compared to the trailing edges of the remaining nozzle vanes, so that chipping and erosion due to a large pressure load during partial load operation is avoided.

7 Claims, 1 Drawing Sheet

FIG. 1 (PRIOR ART)
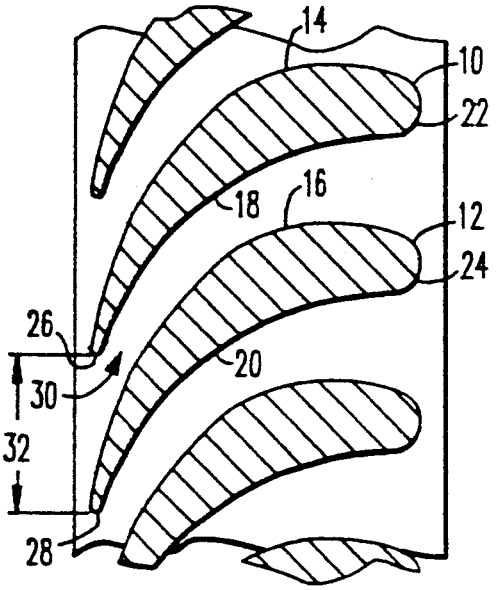
FIG. 3
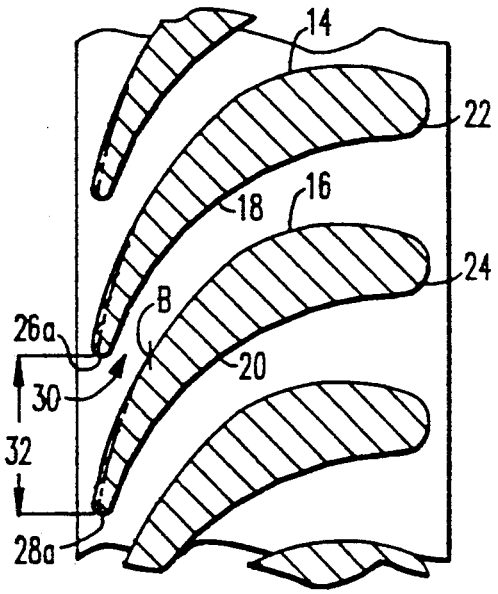
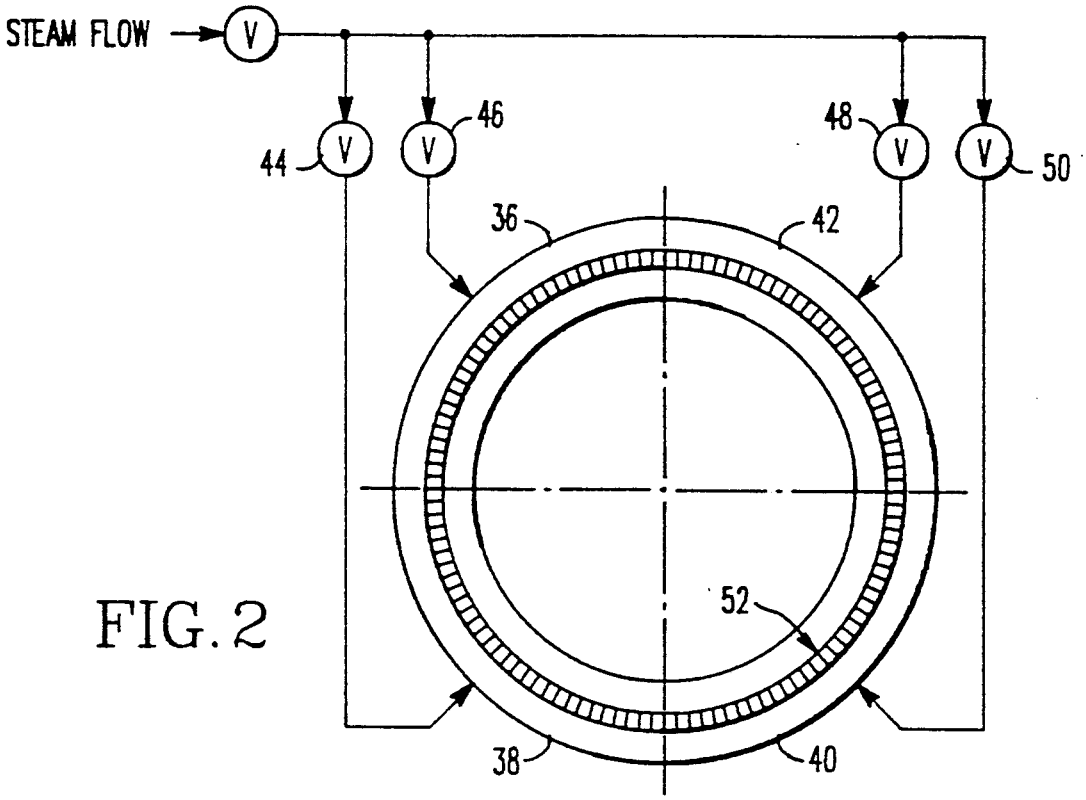
FIG. 2

CONTROL STAGE NOZZLE VANE FOR USE IN PARTIAL ARC OPERATION

BACKGROUND OF THE INVENTION

Field of the Invention

The present invention relates generally to steam turbines and, more specifically, to an improved control stage nozzle vane for use in partial arc operation.

Description of the Related Art

Steam turbine rotary and stationary blades are arranged in a plurality of rows or stages. Usually, the blades of a given row are identical to each other.

The airfoil or vane portion of each rotary or stationary blade includes a leading edge, a trailing edge, a concave surface and a convex surface. The airfoil shape common to a particular row of blades differs from the airfoil shape of every other row within a particular turbine. Likewise, no two turbines of different designs share airfoils of the same shape. The structural differences in airfoil shape result in significant variations in aerodynamic characteristics, stress patterns, operating temperature, and natural frequency of the airfoil. These variations, in turn, determine the operating life of the blades within the boundary conditions (turbine inlet temperature, compressor pressure ratio, and engine speed), which are generally determined prior to airfoil or vane shape development.

Two adjacent control stage nozzle vanes are illustrated in FIG. 1 and are generally referred to by the numerals 10 and 12. Each has a convex, suction surface 14, 16, respectively and opposite side concave or pressure side surfaces 18 and 20, respectively. Each has a leading edge 22, 24, and a trailing edge 26 and 28, respectively. The straight line distance between the trailing edge 26 and the convex surface 16 is referred to as the "throat" opening and is designated by the reference numeral 30. The "pitch" is the distance between trailing edges of adjacent blades and is designated by the reference numeral 32. The gauging of a blade is the ratio of throat to pitch, and is a critical parameter in blade design.

At off-peak or low demand times, such as at night, it is not necessary to run the steam turbine at full power, although the prescribed running speed must be maintained. In order to accomplish this, steam turbines are commonly designed to have a plurality of arcs of admission. For example, as schematically illustrated in FIG. 2, a steam chamber is divided into four segments or four arcs of admission 36, 38, 40 and 42. Each arc of admission is provided with a governor valve 44, 46, 48, and 50, respectively, which are, during full operation, opened to allow steam to enter each of the nozzle chambers (arcs of admission may comprise more than one nozzle chamber).

At low demand, it may only be necessary to allow steam to enter through one or a small group of the nozzle chambers. For example, valve 44 can be placed in an open position, while valves 46, 48 and 50 are shut so that all of the steam entering the turbine is entering through the nozzle chamber 36. At this point, it is said that the turbine is operating in "partial arc operation", and in this case the nozzle chamber 36 represents the primary arc of admission.

The first row 52 of stationary blades is referred to as the control stage nozzle vanes. The trailing edges of the nozzle vanes, particularly in the primary arc of admission, have experienced chipping and erosion because they are exposed to a large pressure load during partial load operation. In other words, due to the fact that only one steam chamber is providing a steam inlet, there is a high pressure difference experienced by the control stage nozzle vanes. The damage that results from this pressure load results in higher maintenance cost due to the requirement of more frequent blade replacement or repair.

SUMMARY OF THE INVENTION

An object of the present invention is to provide a control stage nozzle vane design which is capable of reducing overall maintenance costs.

Another object of the present invention is to prevent chipping and erosion of the trailing edges of nozzle vanes, particularly in the primary arc of admission.

These and other objects of the present invention are met by providing in a steam turbine, a row of nozzle vanes divided into a plurality of circumferentially disposed arcs, one arc providing a primary arc of admission for steam, each nozzle vane having a trailing edge, a leading edge, a pressure side surface and a section side surface, wherein the trailing edges of the nozzle vanes in at least the primary arc of admission are thicker than the remaining nozzle vanes.

In another aspect of the present invention, a method of operating a steam turbine in partial arc operation includes thickening the trailing edges of the nozzle vanes in at least a primary arc of admission for steam so that the trailing edges of the nozzle vanes in at least the primary arc of admission are thicker than the remaining nozzle vanes.

These and other features and advantages of the nozzle vane of the present invention will become more apparent with reference to the following detailed description and drawings.

BRIEF DESCRIPTION OF THE DRAWINGS

FIG. 1 is a sectional view showing two adjacent nozzle vanes of known design;

FIG. 2 is a schematic view of a steam turbine illustrating four arcs of admission, and FIG. 3 is a sectional view of two adjacent nozzle vanes according to the present invention.

DETAILED DESCRIPTION OF THE PREFERRED EMBODIMENTS

The present invention involves providing the nozzle vanes of at least the primary arc of admission, such as arc 36 of FIG. 2, with a thicker trailing edge compared to the trailing edges of the nozzle vanes in the remaining arcs. It goes against conventional wisdom to provide blades of the same row with different shapes; however, any decrease in stage efficiency due to the thicker edge is believed to be outweighted by gains in savings in efficiency of turbine performance with nozzle vane degradation due to erosion or chipping and maintenance cost.

The changes in the trailing edge are illustrated in FIG. 3. The new trailing edges are illustrated as **26*a* and 28*a***. The old trailing edges are shown in phantom lines.

After adding the thicker trailing edge, a uniform flow distribution through the nozzle exits must be maintained by keeping the throat opening and pitch constant. To accomplish this, the radius of curvature on the blades of the primary arc of admission is increased. As shown in FIG. 3, the trailing edge thickness is increased without changing the throat opening 30 or pitch 32 by increasing the radius of curvature along the suction side surfaces 14 and 16. The increase in radius of curvature occurs for a segment of the surface extending from the point B, where the throat opening 30 is measured to the trailing edge. In FIG. 3, a comparison can be made between the normal trailing edge thickness and the thicker trailing edge in a blade whose suction surface has been increased with respect to the radius of curvature. The blade having a thicker trailing edge nonetheless has the same throat opening and pitch as the remaining blades.

When operating the steam turbine in a partial arc operation, such as during a low demand period, the governor valves 46, 48, and 50 are shut, and the governor valve 44 remains open so that the arc 36 becomes the primary arc of admission. The blades in the arc 36 are provided with thicker trailing edges to withstand the large pressure load which results from the partial load operation. Once it has been determined that one of the arcs will be designated a primary arc of admission, such that the blades within the arc are provided with thicker trailing edges, the steam turbine must be operated for partial arc operation only through the arc 36.

Although it is possible to provide a second arc with blades having a thicker trailing edge, it is preferable to provide only one, designated the primary arc of admission.

Numerous modifications and adaptations of the present invention will be apparent to those so skilled in the art and thus, it is intended by the following claims to cover all such modifications and adaptations which fall within the true spirit and scope of the invention.

What is claimed:

1. A steam turbine comprising:

a row of nozzle vanes divided into a plurality of circumferentially disposed arcs, at least one arc being a primary arc of admission for steam, each nozzle vane having a trailing edge, a leading edge, a pressure side surface, and a suction side surface, wherein the trailing edges of the nozzle vanes in at least the primary arc of admission are thicker than the trailing edges of the remaining nozzle vanes of the row.

2. A steam turbine as recited in claim 1, wherein the nozzle vanes of the primary arc of admission and the remaining nozzle vanes have the same throat opening and pitch.

3. A steam turbine as recited in claim 2, wherein the nozzle vanes of the primary arc of admission have an increased radius of curvature over a segment of the suction side surface extending from a point of measurement of the throat opening to the trailing edge.

4. A method of operating a steam turbine having a row of nozzle vanes divided into a plurality of circumferentially disposed arcs, each arc having a governor valve for controlling a supply of steam thereto, the method comprising:

designating at least one of the plurality of arcs as a primary arc of admission;

providing the nozzle vanes of the primary arc of admission with a thicker trailing edge as compared to the trailing edges of the remaining nozzle vanes; and operating the steam turbine in a partial arc of operation, in which the governor valves of all but those of the primary arc of admission are shut.

5. A method of operating a steam turbine as recited in claim 4, wherein the thickening step comprises increasing a radius of curvature of a suction side surface of each of the nozzle vanes in the primary arc of admission.

6. A method of operating a steam turbine as recited in claim 5, further comprising maintaining a constant pitch and throat for all of the nozzle vanes.

7. A method of making nozzle vales from a steam turbine in which a row of nozzle vanes are divided into a plurality of circumferentially disposed arcs, one arc providing a primary arc of admission for steam, each nozzle vane having a trailing edge, a leading edge, a pressure side surface, and suction side surface, the method comprising:

thickening the trailing edges of the nozzle vanes in at least the primary arc of admission, as compared to the trailing edges of the remaining nozzle vanes.

* * * * *